US005343629A

United States Patent [19]

Rae

[11] Patent Number: 5,343,629

[45] Date of Patent: Sep. 6, 1994

[54] UV DRYERS

[75] Inventor: Malcolm C. Rae, Reigate, England

[73] Assignee: G.E.W. (EC) Limited, United Kingdom

[21] Appl. No.: 984,589

[22] PCT Filed: Jul. 15, 1992

[86] PCT No.: PCT/GB92/01293

§ 371 Date: Mar. 9, 1993

§ 102(e) Date: Mar. 9, 1993

[87] PCT Pub. No.: WO93/02329

PCT Pub. Date: Feb. 4, 1993

[30] Foreign Application Priority Data

Jul. 25, 1991 [GB] United Kingdom ..... 9116120.8

[51] Int. Cl.[5] ..... F26B 3/28

[52] U.S. Cl. ..... 34/278; 34/60; 34/611

[58] Field of Search ..... 34/14, 39, 40, 60, 48, 34/4, 1 BB, 148, 18, 68; 250/504 R

[56] References Cited

U.S. PATENT DOCUMENTS 5,117,562 6/1992 Dulay et al. ..... 34/4

FOREIGN PATENT DOCUMENTS 2366012 5/1977 Fed. Rep. of Germany ..... 34/4

2830870 1/1980 Fed. Rep. of Germany ..... 34/4

*Primary Examiner*—Henry A. Bennet

*Attorney, Agent, or Firm*—Lowe, Price, LeBlanc & Becker

[57] ABSTRACT

An air cooled ultraviolet dryer comprises a lamp (6) mounted within a reflector (1) and supported within a housing (2). The mouth of the reflector is closed off with a tubular heat barrier comprising contiguous tubes (10) which are transparent to UV light. Cooling is effected by passing cooling air into space (3) between the housing (2) and the reflector lamps along tubes (10), preferably by applying suction to the outlet at one end of the housing and causing air to flow transversely over the lamp and through the tubes (10).

23 Claims, 5 Drawing Sheets

Fig.4
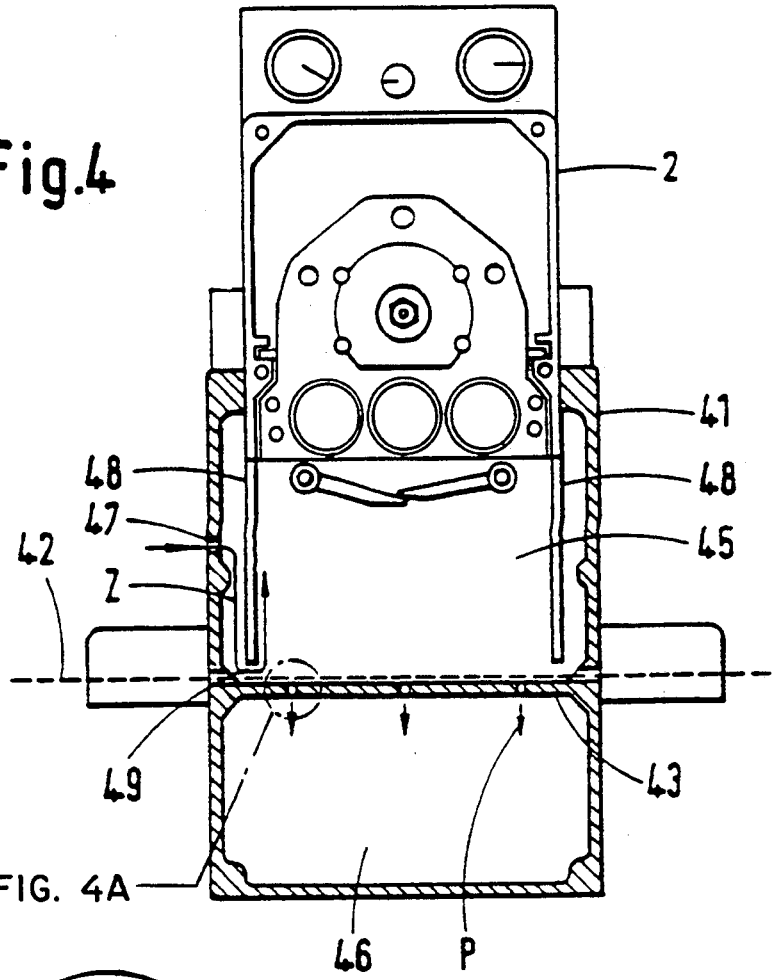
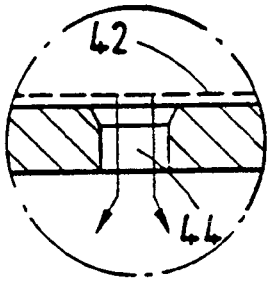
Fig.4A

UV DRYERS

This invention relates to U.V. dryers.

U.V. dryers are used widely in the printing industry for drying photopolymerisable inks. In conventional ultra-violet dryers, the U.V. lamp is disposed transversely to the direction of feed of the printed web or sheets and the U.V. lamp and its housing are conventionally cooled with a combination of air and water. Typically, the lamp reflector is provided with a water jacket through which water is passed, and a separate feed of compressed air is provided to provide a stream of cooling air over the lamp. While water cooling is effective, this is achieved at high cost and imposes further disadvantage of increased weight and complexity. Also, the cooling is relatively inflexible which results in difficulties in maintaining lamp stability at low powers.

According to one aspect of the present invention there is provided an ultra-violet, air-cooled dryer for drying or curing printing inks and other photopolymerisable coatings or layers, wherein a U.V. lamp is supported in the reflector housing for directing U.V. light onto printed sheets or webs, said dryer including air cooling means comprising outlets for pressurised air adapted to bathe said lamp in a stream of cooling air and a tubular heat barrier disposed between the lamp and the path of said sheets or web, said barrier being relatively transparent to U.V. light, but restricting passage of heat by virtue of passing a stream of air along said tubular barrier.

Preferably, the heat barrier comprises one or more tubes which extend longitudinally of the lamp and are connected to a source of filtered air so that cooling air is passed axially along the tube or tubes. The tubes may be manufactured from quartz, which is relatively transparent to U.V. light. Surprisingly, the passage of cooling air axially along the tube or tubes cuts down the transmission of heat across said tubular barrier by a substantial proportion. The outlets for providing the stream of air over the lamp are preferably incorporated in the reflector housing by incorporating a conduit extending longitudinally of the lamp in the reflector adjacent to the lamp, and forming said conduit with axially spaced slots or holes so as to direct a plurality of air streams transversely of the lamp.

Additional passageways are preferably provided for conducting air over the surface of the reflector remote from the lamp and the back surface of the reflector is preferably provided with fins to increase the heat transmission from the reflector to the air stream.

In order to maintain cooling to the web or sheets fed past the U.V. dryer, additional conduit or conduits may be formed in the outer lip of the reflector so as to direct a stream of air onto the sheets or webs which pass beneath the dryer.

An air stream or streams over the reflector and through the tubular heat barrier is preferably induced by applying suction to a housing for the lamp and conducting the cooling air or other gas over and through the components to be cooled. By providing suitable baffles and air passages, higher air pressures can be developed in some parts of the housing and relatively lower pressures in others. This feature can be taken advantage of by, for example, inducing a lower pressure below a table over which the web or printed sheets are passed, thus controlling the web or sheets and preventing curling during drying.

Use of air streams to cool both the lamp and reflector as well as to reduce the infra-red component reflected towards the web by passage through the tubular heat barrier has a further advantage. This is that the ozone which is inevitably produced by the lamp is rapidly diluted in the cooling stream well below safe working limits. In contrast, in conventional dryers in which air cooling is generally confined to the lamp, constant monitoring of the ozone level is necessary.

The infra-red content of the radiation which passes through the tubular heat barrier can be further reduced by applying an IR filter to the surface of the tubular heat barrier. A thin dielectric film may be applied to the surface of the tubular heat barrier. Such films will reflect a large proportion of the IR radiation emitted by the light source, while allowing the U.V. light to pass through.

In a further refinement of the invention, the lamp is provided with shutters adapted to close off the open side of the reflector from the web or sheets, and such shutters are preferably operated by motor means actuated by a sensor which detect the presence or otherwise of a moving sheet or web.

Shutters are advantageous since it is often desirable that the printed sheet should not be over-exposed to U.V. light. It is equally important that the shutters should open rapidly as soon as the printed layer is conveyed to the dryer. A highly controllable shutter system for the reflector of a U.V. dryer comprises a pair of doors hingedly mounted at the mouth of the reflector so as to close towards each other in bat-wing fashion and a closing mechanism comprising a rotary plate, such as a disc, which is linked to the doors by link arms whereby rotation of the plate in one direction causes the doors to close while rotation in the other direction causes the doors to open. Conveniently, an electric stepping motor or an air motor may be used to drive the plate. A shutter system of this kind is thought to be novel per se and may be employed in U.V. dryers which do not possess the particular cooling system described above.

Further features and advantages of the present invention will be apparent from the following description of a preferred embodiment, in which:

FIGS. 4 and 4A are sectional elevations of the dryer combined with a housing.

Figure 2:
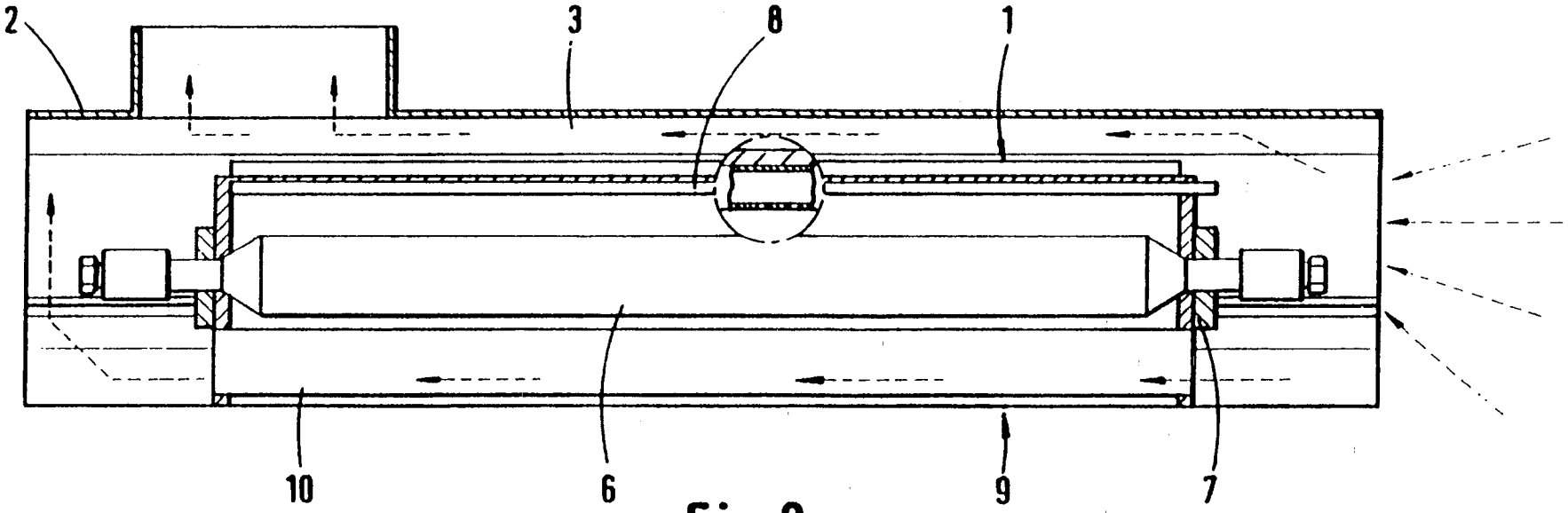
FIG. 2 is a longitudinal section through the dryer.

Referring to the drawings, the U.V. dryer comprises an extruded aluminium reflector 1, which is mounted in a housing 2 so as to provide a space 3 through which pressurised air can be fed longitudinally of the dryer housing, as shown by the direction of the air flow in FIG. 2. The back surface of the reflector mechanism is formed with fins 4, to increase the surface area and thereby the heat loss from the aluminum reflector. The inner surface 5 of the reflector provides a parabolic mirror and the U.V. lamp 6 is mounted approximately at the focus of the mirror surface by means of a mounting bracket 7. A mirror which has a reflecting surface which is non-cylindrical is preferred because cylindrical or part cylindrical reflectors will reflect a high proportion of the light energy back through the lamp. Mounted within a longitudinal recess in the profile of the reflector 1 is a lamp cooling conduit 8 which is formed with a plurality of axially spaced slots or holes (not shown). A U.V. lamp cooling conduit 8 is connected to a source of pressurised and filtered air so that, in operation, a plurality of filtered air streams are directed transversely of the lamp 6 so as to bathe the lamp in a cooling air stream. Alternatively, a similar stream and/or a current of air longitudinal of the lamp can be established by sucking air through the housing as will be described in more detail below.

The open side of reflector 1 is blocked off with a heat barrier 9, formed from three contiguous IR filter tubes 10. Tubes 10 are preferably formed from quartz but any material which is relatively transparent to U.V. light may be used. The tubes 10 extend parallel to the axis of the U.V. tube. Preferably, the outer surfaces of the tubular heat barrier incorporate an IR filter. This can be achieved by applying a thin dielectric coating to the surface of the tubes 10. These coatings are applied commercially by vacuum deposition of materials having selected thicknesses and refractive indices onto the surface of the tubes. The dielectric coatings act as optical interference layers. For example, by applying uniform films having alternate low and high refractive index (e.g. of magnesium fluoride and zinc sulphide) a quarter wave stack can be produced in which the individual films have the same optical thickness as a quarter wavelength in the IR band. In this way, the coating will exhibit a maximum reflectance in the IR band and a maximum transmittance in the U.V. and visible bands. For further discussion of the construction of optical interference dielectric coatings, reference is made to the article by P. Bowmeister and G. Pincus, pages 59 to 75, of Scientific American (223), December 1970. U.V. light emitted from the lamp 6 passes transversely through the IR filter tubes and irradiate the printed web or sheets fed past the open face of the reflector. Air is passed axially along each of the tubes 10 and surprisingly up to 20% of the heat content of the lamp output is removed in this way.

Additional cooling is provided by means of conduits 11 which are received in recesses near the open mouth of the reflector 1. Conduits 11 may be fed with filtered air and are formed with axially spaced holes or slots so as to blow a stream of cooling air over the web or sheets as they are passed across the open mouth of the dryer. The streams of air from conduits 11 are obliquely inclined towards the centreline of the reflector.

Preferably, the lamp assembly incorporates closable shutters which are mounted at the mouth of the lamp reflector. The shutters are provided with an operating mechanism which enables their opening to be timed to correspond with the passage of the printed web or sheets beneath the reflector. When the shutters are in the closed position, the lamp may be controlled to operate at lower power (e.g. by reducing the operating current). In such a phase, it may be desirable to coordinate the closing of the shutters with the reduction of air flow through the lamp housing since over cooling the lamp tends to cause a mercury arc lamp to be shut down.

Figure 3A:
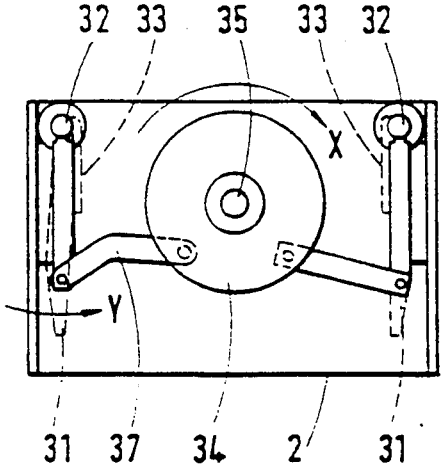
FIGS. 3A and 3B are respectively an end view and a partial horizontal elevation of the shutter mechanism of the dryer.
Figure 3B:
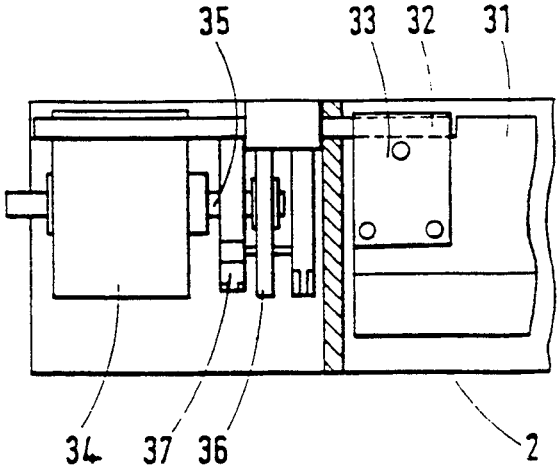
Figure 3C:
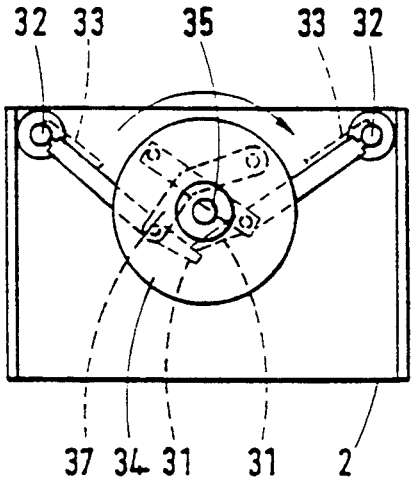
FIG. 3C is a view similar to FIG. 3A but with the shutters in a closed position.

FIGS. 3A, 3B and 3C show the mechanism for operating the shutters. Mounted on one end of the lamp housing 2 is the operating mechanism for a pair of shutters 31, which consist in a pair of shutter blades. The shutter blades are each pivotably mounted on an associated shaft 32 via a pivot plate 33. In the operational condition of the lamp, the shutter blades lie parallel with the longitudinal side members of the lamp housing so as not to impede the passage of light from the lamp. This condition is illustrated in FIG. 3A. Also, in FIG. 3C, the position of the blades in the closed position is indicated. As can be seen, one blade closes just before the other and the second blade closes onto the first.

Pivoting of the shutter blades is effected by a rotary actuator 34, (which may be driven pneumatically, hydraulically or by electric power). The rotary actuator is connected by a drive shaft 35 to a driven disc 36. The shutter blades 31 are linked to the disc 36 by lever arms 37. The arrangement is such that on effecting rotation of the actuator in the direction of the arrow X in FIG. 3A, the shutter blades are pivoted towards each other as indicated by the arrow Y until they touch or overlap.

In order to secure a proper degree of cooling of the lamp, the volume of air drawn through the lamp housing is coordinated with the output of the lamp and whether the shutters are open or closed. This increases the operating life of the lamp. For example, the lamp may have high and low operating levels which are controlled, e.g. by thyristor control of the electrical power supply. Changing the lamp output to a lower level triggers a reduction in the air flow through the housing either by reducing the speed of a fan or blower supplying air to the housing and to the lamp cooling outlets or by operating a valve which diverts some of the air to atmosphere. The cycle may be triggered by closing the shutter blades, which signals a reduction in the air flow and reduction in the power output of the lamp. Where a pneumatic actuator is employed to drive the shutter blades, a pneumatic signal may be used to actuate the other functions.

Figure 5:
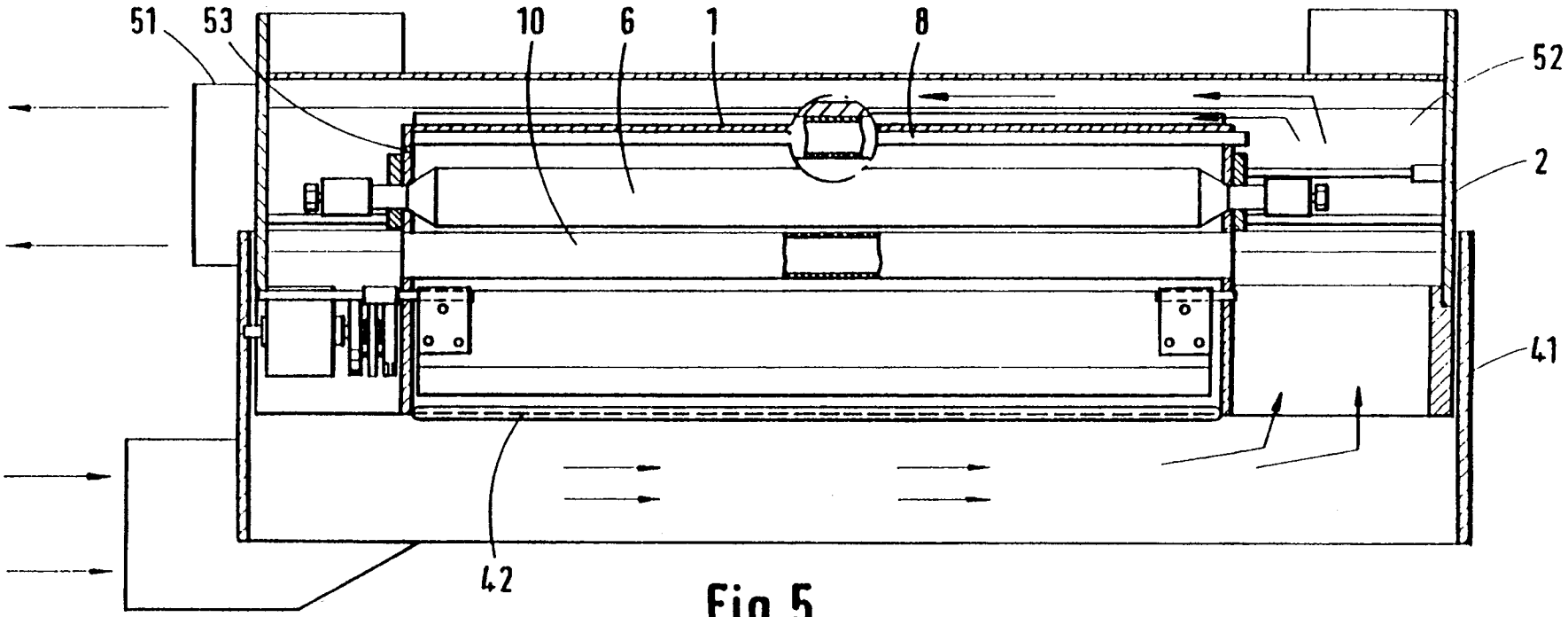
FIG. 5 is a longitudinal view of the dryer in the housing and showing the air flow over components of the dryer.

Referring to FIGS. 4 and 5, the lamp housing is fitted into a lower housing 41 to provide an enclosed space through which a printed web 42 is conducted beneath the lamp. Web 42 is guided to run over a table 43 which is apertured at 44 and forms a partition between upper chamber 45 and lower chamber 46

Apertures 47 are provided in the side walls of housing 41 and reflector housing 2 includes extension side walls forming baffles 48. Thus, U.V. light emitted by the lamp 6 is prevented from being reflected or diffused from the housings 2 and 41. In order to allow air to enter the chamber 45, a hole or notch 49 is formed in the base of baffle 48 thus inducing an air flow as indicated by path Z. By making the air flow into chamber 45 greater than that into chamber 46, a secondary flow is induced, as indicated at P, through the apertures 44 in table 43, because the air pressure in chamber 46 will be lower than in chamber 45. This has the useful effect of holding the web flat against the table as it travels through the chamber 45, thus avoiding curling at its edges.

Figure 1:
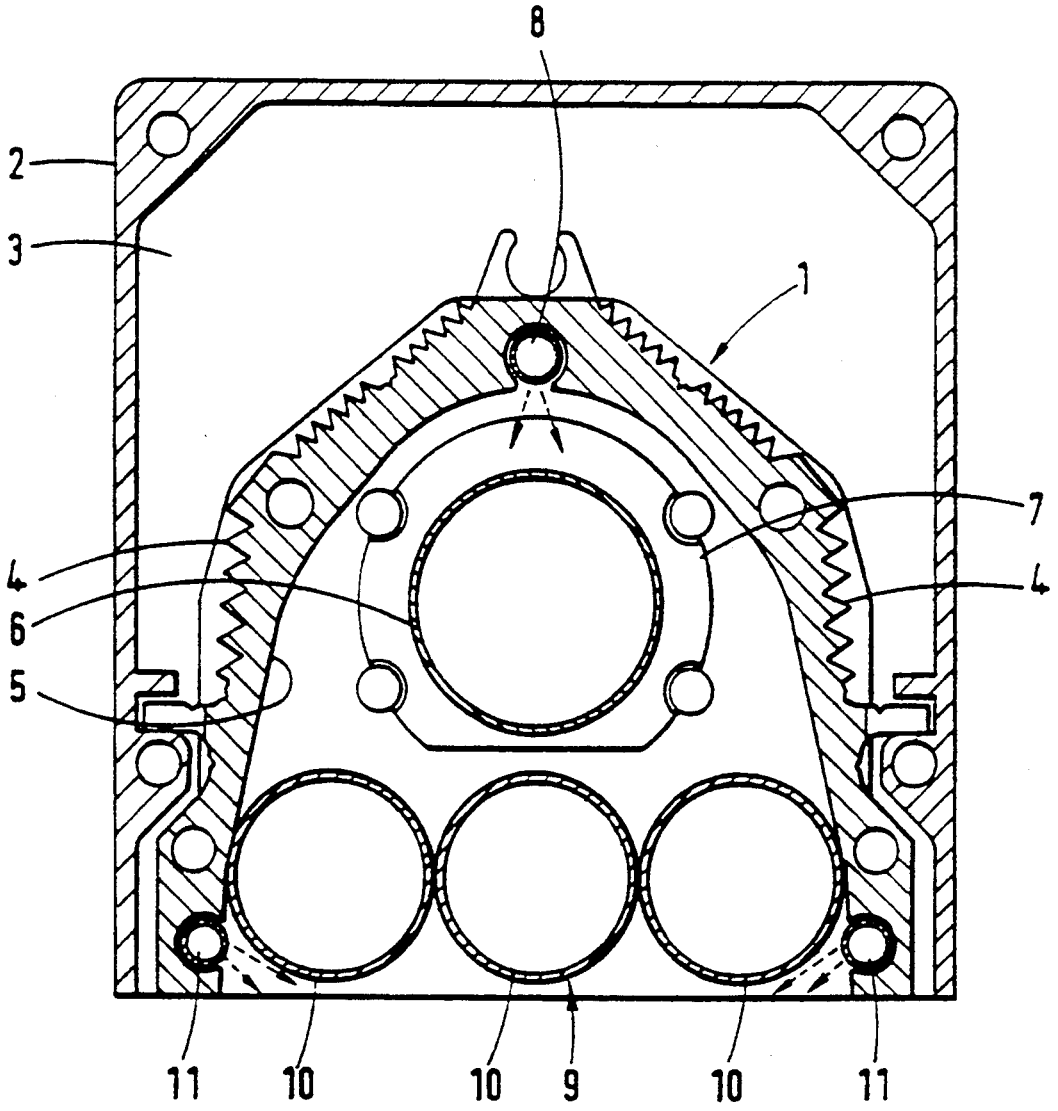
FIG. 1 is a cross-section through the dryer.

As shown in FIG. 5, air flow through the housings is preferably achieved by applying suction to the outlet 51 from the reflector housing 2. This is conveniently effected by connecting outlet 51 to the input of a centrifugal air blower (not shown). As a result, air is sucked into the housing 41, preferably through filters (not shown) and is guided by suitable partitions and baffles through the tubes 10, over the reflector 1 and over the lamp 6. The arrows in FIG. 5 indicate the streams of cooling air which are developed. It will be seen, particularly from FIG. 1, that the cross-sectional areas of the tubes 10 and the space 3 between the reflector and housing 2 is relatively large. In contrast, the air stream which passes over the lamp passes through relatively small slots 8 in the reflector housing, although some air flow could be induced longitudinally of the lamp by providing space between the lamp and its mounting at the end 52 of the housing. A space 53 is provided at the other end of the lamp in order to induce air to flow through the slots 8. Alternatively, a separate compressed air feed of filtered air may be supplied to slotted or perforated tube 8. This arrangement ensures that a readily controllable quantity of air can be supplied to the lamp and filtered air is only supplied to that part of the dryer which benefits from such a supply. Additional baffles can, if desired, be arranged in the space 52 at one end of the lamp to accentuate or modify this effect. As a consequence, ozone which is inevitably produced as a by-product of the U.V. radiant energy as oxygen in the air, is rapidly diluted within the housing so that the concentration of ozone in the exhaust air from outlet 51 is well within safe working levels.

Dryers manufactured in accordance with the invention have the advantages that they can be constructed in a much more compact size, compared with conventionally cooled lamps of similar output. Secondly, forced air cooling of the lamp does enable the lamp to be operated at lower outputs without loss of stability. The quartz tubes 10 absorb heat from the radiation produced by the U.V. lamp (e.g. a mercury vapour lamp), and the axially blown air through the tubes 10 removes a substantial part of the heat transferred to the tubes. Typically, the quartz tubes 10 are about 20 to 40 mms in diameter. Air is passed along tubes 10 at high velocity in order to maintain a desired cooling. Suitably, the air flow through the lamp housing is in the range of about 160 to 170 cubic feet per minute.

I claim:

1. An ultra-violet air-cooled dryer for drying printing inks and other U.V. photopolymerisable materials wherein a U.V. lamp is supported in a reflector housing having an open mouth for directing U.V. light onto printed sheets or web, said dryer including first air-cooling means comprising means for establishing a stream of cooling air over said lamp and a tubular heat barrier disposed between the lamp and the path of said sheets or web, and blocking off the mouth of said housing and second air-cooling means for causing a stream of air to flow through said tubular barrier.

2. A dryer according to claim 1 wherein the heat barrier comprises two or more substantially contiguous tubes extending longitudinally of the lamp but spaced therefrom.

3. A dryer according to claim 2 wherein the tube or tubes include infra-red filter means which is substantially transparent to U.V. light.

4. A dryer according to claim 3 wherein the infra-red filter means comprises a dielectric coating on a surface of the tube or tubes.

5. A dryer according to claim 1 wherein said first cooling means cooling air over the lamp comprise outlets arranged to direct.

6. A dryer according to claim 5 wherein the outlets are located in a tubular passage way in the reflector and are fed with air from one end thereof from a source of filtered air.

7. A dryer according to claim 1 wherein additional passageways are provided for passing an air stream over the surface of the reflector remote from said lamp.

8. A dryer according to claim 1 which includes air conduit means disposed in the vicinity of the mouth of the reflector so as to direct a stream of air onto the printed sheets or webs as they pass beneath the dryer.

9. A dryer according to claim 1 in which the stream of air through the tubular barrier is produced by application of suction to the reflector housing.

10. A dryer according to claim 9 in which air is drawn into the housing through apertures into a first chamber between the reflector and the web or sheets and develops an air pressure which is higher than that of a second chamber below said web or sheets whereby the latter are held down in contact with an apertured partition between the two chambers.

11. A dryer according to claim 1 which includes shutters for closing off the mouth of the reflector, said shutters comprising a pair of doors which are hinged at one end and close towards each other and a closing mechanism comprising a rotary plate which is linked to the doors by link arms so as to close the doors on rotating the plate in one direction and to open the doors when rotated in the other.

12. An ultraviolet dryer which comprises a U.V. lamp mounted in a reflector and having means for cooling the lamp, the open mouth of the reflector being closable by a pair of shutters, each shutter comprising a blade pivotably mounted longitudinally of the reflector and being closable by pivoting towards each other, and an operating mechanism for the shutters comprising a rotary plate and link arms linking each shutter to the plate so that rotation of the plate in one direction causes the shutters to close while rotation in the opposite direction causes the shutters to open.

13. A dryer as claimed in claim 7, wherein said reflector has finned back surfaces and means are provided for directing said air stream over said back surface.

14. A dryer as claimed in claim 7, wherein the stream of air over the surface of the reflector is produced by application of suction to the reflector housing.

15. A dryer as claimed in claim 6, wherein said source of filtered air is a compressed air source.

16. An ultra-violet air-cooled dryer which comprises:

(a) a U.V. lamp supported in a reflector housing having an open mouth for directing U.V. light onto printed sheets or web having a path passing beneath the reflector, (b) air-cooling means for establishing a stream of cooling air over said lamp, and (c) a tubular heat barrier disposed between the lamp and the path of said sheets or web, said barrier being relatively transparent to U.V. light but restricting passage of heat by virtue of a stream of air passing along said tubular barrier and infra-red filter means comprising a dielectric coating on the surface of the tubular barrier.

17. A dryer as claimed in claim 16, wherein the tubular barrier comprises two or more substantially contiguous tubes blocking off the mouth of the reflector housing.

18. An ultra-violet air-cooled dryer which comprises:

(a) a U.V. lamp supported in a reflector housing having an open mouth for directing U.V. light onto printed sheets or web having a path passing beneath the reflector, (b) air-cooling means for establishing a stream of cooling air over said lamp, and (c) a tubular heat barrier disposed between the lamp and the path of said sheets or web, said barrier being relatively transparent to U.V. light but restricting passage of heat by establishing a stream of air along said tubular barrier by application of suction to the reflector housing.

19. A dryer as claimed in claim 18, wherein the application of suction to said housing causes air to flow over the surface of the reflector.

20. A dryer as claimed in claim 18, wherein the air-cooling means for the lamp comprises a source of filtered air separate from the air passing through the tubular barrier.

21. A dryer as claimed in claim 18, in which air is drawn into the reflector housing through apertures in a first chamber between the reflector and the web or sheets and develops an air pressure which is higher than that of a second chamber below said web or sheets whereby the latter are held down in contact with an apertured partition between the two chambers.

22. An ultra-violet air-cooled dryer which comprises:

(a) a U.V. lamp supported in a reflector housing having an open mouth for directing U.V. light onto printed sheets or web having a path passing beneath the reflector, (b) air-cooling means for establishing a stream of cooling air over said lamp, (c) a tubular heat barrier disposed between the lamp and the path of said sheets or web, said barrier being relatively transparent to U.V. light but restricting passage of heat by virtue of a stream of air passing along said tubular barrier, (d) shutters arranged to close off the mouth of the reflector, said shutters comprising a pair of doors which are hinged at one end to close towards each other, and (e) a closing mechanism for the shutters comprising a rotary plate which is linked to the doors by link arms so as to close the doors on rotating the plate in one direction and to open the doors on rotating the plate in the opposite direction.

23. A dryer as claimed in claim 12, wherein said link arms are pivotally connected at positions on said plate such that on rotating the plate to close the shutters, one shutter closes just before the other.

* * * * *